US009000941B2

(12) United States Patent
Hohl et al.

(10) Patent No.: US 9,000,941 B2
(45) Date of Patent: Apr. 7, 2015

(54) ALTERNATING FREQUENCY TIME DOMAIN APPROACH TO CALCULATE THE FORCED RESPONSE OF DRILL STRINGS

(71) Applicants: Andreas Hohl, Hannover (DE); Frank Schuberth, Celle (DE); Hanno Reckmann, Nienhagen (DE)

(72) Inventors: Andreas Hohl, Hannover (DE); Frank Schuberth, Celle (DE); Hanno Reckmann, Nienhagen (DE)

(73) Assignee: Baker Hughes Incorporated, Houston, TX (US)

( * ) Notice: Subject to any disclaimer, the term of this patent is extended or adjusted under 35 U.S.C. 154(b) by 200 days.

(21) Appl. No.: 13/771,749

(22) Filed: Feb. 20, 2013

(65) Prior Publication Data

US 2014/0232548 A1 Aug. 21, 2014

(51) Int. Cl.

| | |
|---|---|
| ***G01V 3/00*** | (2006.01) |
| ***E21B 23/00*** | (2006.01) |
| ***E21B 17/10*** | (2006.01) |
| ***E21B 17/00*** | (2006.01) |

(52) U.S. Cl.

CPC ..... *E21B 17/00* (2013.01)

(58) Field of Classification Search

CPC ..... E21B 47/12; E21B 14/026; E21B 4/18

USPC ..... 340/854.4, 853.3, 856.2; 166/212, 381, 166/382, 206, 217; 175/45, 99, 230

See application file for complete search history.

(56) References Cited

U.S. PATENT DOCUMENTS

| | | | | |
|---|---|---|---|---|
| 5,226,332 | A | 7/1993 | Wassell | |
| 5,402,677 | A | 4/1995 | Paslay et al. | |
| 6,205,851 | B1 | 3/2001 | Jogi | |
| 6,408,953 | B1 * | 6/2002 | Goldman et al. | 175/39 |
| 8,214,188 | B2 | 7/2012 | Bailey et al. | |
| 2005/0283315 | A1 | 12/2005 | Haugland | |
| 2008/0230272 | A1 * | 9/2008 | Chen et al. | 175/45 |
| 2010/0032165 | A1 * | 2/2010 | Bailey et al. | 166/369 |
| 2011/0186353 | A1 | 8/2011 | Turner et al. | |

OTHER PUBLICATIONS

Notification of Transmittal of the International Search Report and the Written Opinion of the International Searching Authority, or the Declaration; PCT/US2014/017361; Jun. 17, 2014, 10 pages.

Cameron, et al. "An Alternating Frequency/Time Domain Method for Calculating the Steady-State Response of Nonlinear Dynamic Systems". Journal of Applied Mechanics 56 (1989), S. 149-154.

(Continued)

*Primary Examiner* — Fekadeselassie Girma

(74) *Attorney, Agent, or Firm* — Cantor Colburn LLP

(57) ABSTRACT

A method for estimating a steady state response of a drill string in a borehole includes calculating a first displacement of the drill string in a frequency domain for a first excitation force frequency and a number of multiples of this frequency using an equation of motion of the drill string. The equation of motion has a static force component, an excitation force component, and a non-linear force component with respect to at least one of a deflection and a derivative of the deflection of the drill string. The method further includes: transforming the first displacement from the frequency domain into a time domain; calculating a non-linear force in the time domain; calculating a frequency domain coefficient derived from the calculated non-linear force in the time domain; and calculating a second displacement of the drill string in the frequency domain using the equation of motion and the frequency domain coefficient.

24 Claims, 5 Drawing Sheets

(56) References Cited

OTHER PUBLICATIONS

Cardona, A., et al. "A Multiharmonic Method for Non-Linear Vibration Analysis". International Journal for Numerical Methods in Engineering 37 (1994), S. 1593-1608.

Chen, et al. "Periodic Forced Response of Structures Having Three-Dimensional Frictional Constraints". Journal of Sound and Vibration.vol. 229, Issue 4, Jan. 27, 2000, pp. 775-792.

Crisfield, M.A., "A fast incremental/iterative solution procedure that handles snap-through". Computers and Structures 13 (1981), Nr. 1, S. 55-62.

Dewayne, et al. "Evaluation of Heave-Induced Dynamic Loading on Deepwater Landing Strings". SPE087152. Society of Petroleum Engineers, 2004 IADC/SPE Drilling Confernece Dallas, Mar. 2-4 pp. 230-237.

Dykstra, "Nonlinear Drill String Dynamics". The University of Tulsa, The Graduate School, 1996, pp. 1-260.

Laxalde, et al. "Qualitative analysis of forced response of blisks with friction ring dampers". European Journal of Mechanics-A/Solids. (Jul. 26, 2007) 676-687.

Padmanabhan, C.; Singh, R., "Analysis of periodically excited Non-linear Systems by a Parametric Continuation Technique". Journal of Sound and Vibration (1995) 184(1), 35-58.

Petrov, E. P., et al, "Analytical Formulation of Friction Interface Elements for Analysis of Nonlinear Multi-Harmonic Vibrations of Bladed Discs" Proceedings of the ASME Turbo Expo—2002, Gas Turbine Technical Congress and Exposition 2002. Amsterdam, Jun. 3-6, 2002. GT-2002-30325, pp. 1-10.

Poudou, O. J. "Modeling and Analysis of the Dynamics of Dry-Friction-Damped Structural Systems", University of Michigan, Dissertation, 2007. pp. 1-193.

Riks, E. "An incremental approach to the solution of snapping and buckling problems" International Journal of Solids and Structures 15 (1979), Nr. 7, S. 529-551.

Yang, B., et al. "Stick-Slip-Separation Analysis and Non-Linear Stiffness and Damping Characterization of Friction Contacts Having Variable Normal Load" Journal of Sound and Vibration (1998), 210(4), 461-481.

* cited by examiner

ALTERNATING FREQUENCY TIME DOMAIN APPROACH TO CALCULATE THE FORCED RESPONSE OF DRILL STRINGS

BACKGROUND

Boreholes are drilled into the earth for various reasons such as exploration and production for hydrocarbons and geothermal energy in addition to sequestration of carbon dioxide. A borehole is typically drilled using a drill bit disposed at the distal end of a series of connected drill pipes referred to as a drill string. A drill rig rotates the drill string, which rotates the drill bit, to cut into the earth to create the borehole. As the borehole is drilled deep into the earth, the drill string may bend and vibrate due to force imbalances on the drill string. Excessive vibrations can delay drilling and possibly cause damage, both of which may significantly affect the cost of drilling. Hence, it would be appreciated in the drilling industry if a method could be developed to mathematically model a drill string with high physical accuracy and in real time in order to improve drilling efficiency.

BRIEF SUMMARY

Disclosed is a method for estimating a steady state response of a drill string disposed in a borehole penetrating at least one of the earth and another material. The method includes calculating a first displacement of the drill string in a frequency domain for a first excitation force frequency and a number of multiples of this frequency using an equation of motion of the drill string that is solved by a processor. The equation of motion has a static force component, an excitation force component, and a non-linear force component with respect to at least one of a deflection and a derivative of the deflection of the drill string. The method further includes transforming the first displacement from the frequency domain into a time domain using the processor; calculating a non-linear force in the time domain based on at least one of the calculated displacement and a derivative of the calculated displacement using the processor; calculating a frequency domain coefficient derived from the calculated non-linear force in the time domain using the processor; and calculating a second displacement of the drill string in the frequency domain using the equation of motion and the frequency domain coefficient using the processor.

Also disclosed is a method for drilling a borehole penetrating an earth formation. The method includes: drilling a borehole with a drill rig that operates a drill string having a drill bit; obtaining borehole geometry data; and calculating a first displacement of the drill string in a frequency domain for a first excitation force frequency using an equation of motion of the drill string that is solved by a processor. The equation of motion has a static force component, an excitation force component, and a non-linear force component with respect to at least one of a deflection and a derivative of the deflection of the drill string. The method further includes: transforming the first displacement from the frequency domain into a time domain using the processor; calculating a non-linear force in the time domain based on the borehole geometry data and at least one of the calculated displacement and a derivative of the calculated displacement using the processor; calculating a frequency domain coefficient derived from the calculated non-linear force in the time domain using the processor; and calculating a second displacement of the drill string in the frequency domain using the equation of motion and the frequency domain coefficient using the processor; and transmitting a control signal from the processor to the drill rig to control a drilling parameter, the processor being configured to execute a control algorithm having the second displacement as an input.

Further disclosed is an apparatus for drilling a borehole penetrating an earth formation using a drill rig configured to operate a drill string having a drill bit. The apparatus includes: a borehole caliper tool disposed at the drill string and configured to provide borehole geometry data; and a processor configured to receive the borehole geometry data and to implement a method. The method includes: calculating a first displacement of the drill string in a frequency domain for a first excitation force frequency using an equation of motion of the drill string, the equation of motion having a static force component, an excitation force component, and a non-linear force component with respect to at least one of a deflection and a derivative of the deflection of the drill string; transforming the first displacement from the frequency domain into a time domain; calculating a non-linear force in the time domain based on the borehole geometry data and at least one of the calculated displacement and a derivative of the calculated displacement; calculating a frequency domain coefficient derived from the calculated non-linear force in the time domain; and calculating a second displacement of the drill string in the frequency domain using the equation of motion and the frequency domain coefficient. The apparatus further includes a controller configured to receive the second displacement and to transmit a control signal to the drill rig to control a drilling parameter, the controller being configured to execute a control algorithm having the second displacement as an input.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are method and apparatus for mathematically modeling motion of a drill string rotating in a borehole. The method calculates a steady-state response of the drill string while considering non-linear contact forces with the borehole wall. The method employs aspects of a Multi-Harmonic Balance Method and an Alternating Frequency Time Domain Method to accurately model the dynamics of the drill string.

Once the steady state response is calculated, one or more drilling parameters may be adjusted to minimize vibration of the drill string.

Figure 1:
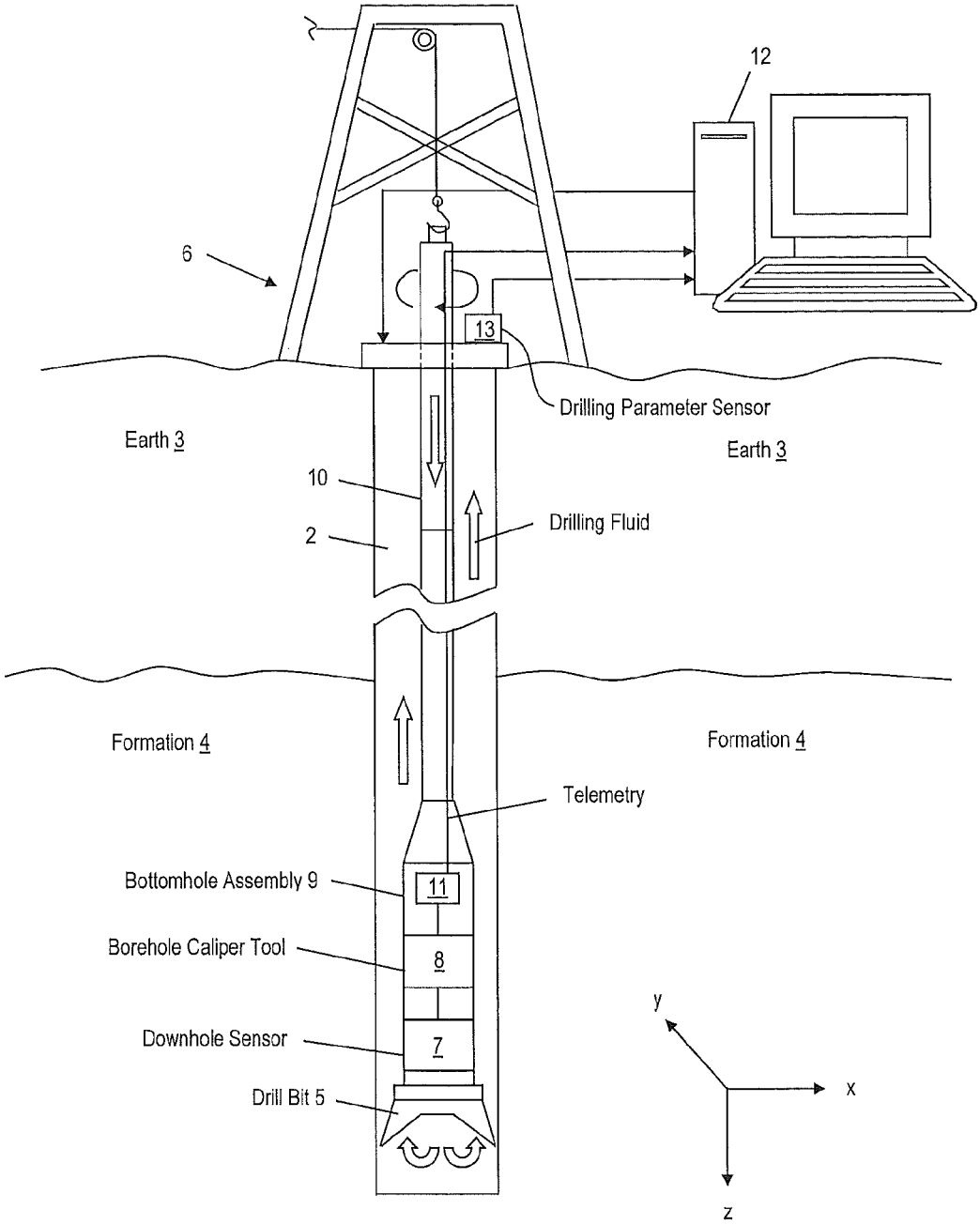
FIG. 1 illustrates a cross-sectional view of an exemplary embodiment of a drill string disposed in a borehole penetrating the earth.

FIG. 1 illustrates a cross-sectional view of an exemplary embodiment of a drill string 10 disposed in a borehole 2 penetrating the earth 3, which may include an earth formation 4. The formation 4 represents any subsurface material of interest, such as a rock formation, that is being drilled. In other embodiments, the borehole 2 may penetrate materials other than the earth. The drill string 10 is generally made up of a plurality of drill pipe sections coupled together. A drill bit 5 is disposed at the distal end of the drill string 10. A drill rig 6 is configured to conduct drilling operations such as rotating the drill string 10 at a certain rotational speed and torque and, thus, rotating the drill bit 5 in order to drill the borehole 2. In addition, the drill rig 6 is configured to pump drilling fluid through the drill string 10 in order to lubricate the drill bit 5 and flush cuttings from the borehole 2. A downhole sensor 7 is disposed in a bottomhole assembly (BHA) 9 coupled to the drill string 10. The downhole sensor 7 is configured to sense a downhole parameter of interest that may provide input to the method disclosed herein. A downhole caliper tool 8 is also disposed in the BHA 9. The downhole caliper tool 8 is configured to measure the caliper (i.e., shape or diameter) of the borehole 2 as a function of depth to provide a caliper log. In one or more embodiments, the downhole caliper tool 8 is a multi-finger device configured to extend fingers radially to measure the diameter of the borehole 2 at a plurality of locations about the longitudinal axis of the drill string 10. The number of measurement locations provides a measured shape for about 360° around the borehole 2. Alternatively, in one or more embodiments, the caliper tool 8 is an acoustic device configured to transmit acoustic waves and receive reflected acoustic waves in order to measure the borehole caliper. The borehole caliper log data may be input into a computer processing system 12, which may then process the data to provide a three-dimensional mathematical model of the borehole 2. Other borehole data may also be entered into the model such as borehole wall stiffness or other physical parameters related to the borehole wall. This other borehole data may be obtained by downhole sensors disposed at the drill string 10 or from data obtained from similar previously drilled boreholes.

Still referring to FIG. 1, downhole electronics 11 are configured to operate downhole sensors and tools, process measurement data obtained downhole, and/or act as an interface with telemetry to communicate data or commands between downhole sensors and tools and the computer processing system 12 disposed at the surface of the earth 3. Non-limiting embodiments of the telemetry include pulsed-mud and wired drill pipe. System operation and data processing operations may be performed by the downhole electronics 11, the computer processing system 12, or a combination thereof. The sensors and tools may be operated continuously or at discrete selected depths in the borehole 2. Alternatively, the sensors and tools may disposed at a wireline carrier that is configured to traverse and log a previously drilled borehole section before drilling is continued using the drill string. A drilling parameter sensor 13 may be disposed at the surface of the earth 3 or downhole. The drilling parameter sensor 13 is configured to sense a drilling parameter related to the drilling of the borehole 2 by the drill string 10. The drilling parameter is indicative of a force imposed on the drill string. For example, the weight on the drill bit (i.e., weight-on-bit) controlled by the hook system is indicative of a force applied to the drill string. The sensor 13 is coupled to the computer processing system 12, which may be configured as a controller, for controlling one or more drilling parameters that affect the vibration of the drill string.

The method includes calculating a frequency response, which relates to the displacement of the drill string with a harmonic force excitation specific frequency and multiples of this frequency. Every periodic excitation force can be approximated with a specific Fourier series. The method is especially suitable to calculate the answer (i.e., forced response) in the frequency range of the exciting force applied to the drill string 10. The following steps may be performed, not necessarily in the order presented, to calculate the forced response of the drill string.

Step 1 calls for defining the geometry of the drill string. In one or more embodiments, the geometry may be imported from a computer-aided-design (CAD) program. This step may also include defining the mass and mass distribution of the drill string.

Step 2 calls for building a discretized or analytical model of the drill string considering the geometry of the drill string (e.g. a Finite-Element-Model). Beam elements may be used which are nonlinear with respect to their deflection. The degrees of freedom of the nodes representing the structure can be the three translational (e.g. x, y, z) and the three rotational degrees of freedom (e.g., $\phi_x,\phi_y,\phi_z$).

Step 3 optionally calls for reducing the number of degrees of freedom of the built model. This can include a modal reduction when the Finite Element Model is used that relates to using only modes in the frequency range of interest. Alternatively, substitution of linear degrees of freedom may be substituted for non-linear degrees of freedom as discussed further below. Further, it is possible to derive ansatz functions from calculated frequency response functions with similar parameters using singular value decomposition or similar approaches. Additional ansatz functions to reduce the degrees of freedom can be derived from measurements.

Step 4 calls for importing the survey or geometry of the borehole, which may be obtained from a borehole caliper log or a well plan. In one or more embodiments, the borehole geometry is modeled using a minimum curvature method, which may use adjacent circles to approximate the geometry.

Step 5 calls for calculating a static solution of the model of the drill string in the borehole. Boundary conditions of the structure are defined using the imported geometry of the drill string and the borehole. For example, the axial deflection at the top of the drill string (i.e., at the hook) may be set to zero. The static deflection of the Finite-Element-Model of the drill string is calculated under consideration of the survey geometry. The survey geometry can be considered by a penalty formulation of the contact between the drill string and the borehole wall. A force proportional to the intersection of drill string and borehole wall is generated. The solution is nonlinear and therefore requires an iterative solution (e.g., using a Newton like solver) because the wall contacts are nonlinear (separation vs. contact) and there are nonlinear geometric forces due to the nonlinearity of the finite elements. Wall contact forces and intersections are calculated in this step. The influence of drilling fluid can be included in this step. The density and viscosity of the fluid influences the external damping of the drill string. This influence can be included in the non-linear forces, which may be amplitude and velocity dependent.

Step 6 calls for calculating a mass matrix M and a stiffness matrix K with respect to the static solution. Therefore, the nonlinear geometric forces are linearized. This is equal to the development of the Taylor series of the nonlinear geometric forces.

Step 7 calls for calculating a dynamic stiffness matrix S. Additionally, a damping matrix C can be considered and calculated. Valid approximations of the damping matrix C are Rayleigh damping or structural damping. The equation of motion may be written as $M\ddot{x}+C\dot{x}+Kx=f+f_{nl}$ where f is a force matrix or vector representing the dynamic force applied to the drill string, $f_{nl}$ is a non-linear force matrix or vector representing non-linear forces applied to the drill string, and x is a displacement vector. The single dot represents the first derivative with respect to time and the two dots represent the second derivative with respect to time.

Step 8 calls for calculating a steady state solution of the system in response to an external excitation force as described in the several following sub-steps.

In sub-step 8*a*, an excitation frequency ω is chosen (the first harmonic of the Fourier series described in step 8*b*). The frequency is chosen in the parameter area of interest.

In sub-step 8*b*, the dynamic force f is defined, which is a vector with the size of all degrees of freedom of the drill string. This can be for example an excitation due to an eccentric mass imbalance on the drill string or a driving force. The periodic excitation force can generally be nonlinear but is developed into a Fourier series with a limited number n of harmonics i:

$$f(t) = f_0 + \sum_{i=1}^{n} f_{sin,i}\sin i\omega t + f_{cos,i}\cos i\omega t.$$

Complex notation and other alternatives are also possible. The amplitudes in the frequency domain and $f_{sin,i}$ and $f_{cos,i}$ for the harmonic i can be written in a vector:

$$f = \begin{bmatrix} f_0 \\ f_{sin,1} \\ f_{cos,1} \\ f_{sin,2} \\ f_{cos,2} \\ f_{sin,3} \\ \vdots \\ f_{cos,n} \end{bmatrix}.$$

In sub-step 8*c*, the displacement x is also developed into a Fourier series with the same number of harmonics n where $x_0$ is an additional static response:

$$x(t) = x_0 + \sum_{i=1}^{n} x_{sin,i}\sin i\omega t + x_{cos,i}\cos i\omega t.$$

The corresponding vector x in the frequency domain is:

$$x = \begin{bmatrix} x_0 \\ x_{sin,1} \\ x_{cos,1} \\ x_{sin,2} \\ x_{cos,2} \\ x_{sin,3} \\ \vdots \\ x_{cos,n} \end{bmatrix}.$$

In sub-step 8*d*, the dynamic stiffness matrix S is calculated by inserting this approach into the equation of motion in step 7. For the specific frequency ω, S is defined as $$s = \begin{bmatrix} K & & & & & & & & & & \\ & K-\omega^2 M & Kd_0 & & & & & & & & \\ & -Kd_0 & K-\omega^2 M & & & & & & & & \\ & & & \ddots & & & & & & & \\ & & & & K-(i\omega)^2 M & iKd_0 & & & & & \\ & & & & -iKd_0 & K-(i\omega)^2 M & & & & & \\ & & & & & & \ddots & & & & \\ & & & & & & & K-(n\omega)^2 M & nKd_0 & & \\ & & & & & & & -nKd_0 & K-(n\omega)^2 M & & \end{bmatrix}.$$

In sub-step 8*e*, a residual vector r is defined as:

$$r=Sx-f_{exe}-f_{nl}(x).$$

The solution is gained if r=0. Without nonlinear (e.g. contact) forces $f_{nl}$, the amplitude vector x can be calculated as:

$$x=S^{-i}f.$$

Since the nonlinear forces $f_{nl}(x)$ are dependent on the displacement x, an iterative solution is necessary. For example, the displacement $x_1$ leads to the nonlinear forces $f_{nl}(x_1)$. A new displacement can be derived from:

$$x_2=S^{-1}(f+f_{nl}(x_1)).$$

The new residual value $r_2=Sx_2-f_{exe}-f_{nl}(x_2)\neq 0$ is generally not equal to zero. A special solver is needed for this problem, e.g. the well-known Newton like solvers. An analytical calculation of the Jacobi matrix may improve the convergence and the calculation time. A challenge is to derive the nonlinear forces like friction forces or wall contact forces. These cannot be calculated in the frequency domain that is from the vector x with the amplitudes of the Fourier coefficients of the single harmonics i=1 . . . n.

In sub-step 8*f* having sections i-v, an alternating frequency time domain approach is presented to overcome the above challenge. In section 8*f*(*i*), a starting vector $x_{Start}$ is calculated e.g. as the linear solution of the problem without nonlinear forces. The inverse Fourier transformation is used to calculate the displacement in the time domain:

$$x(t) = x_0 + \sum_{i=1}^{n} x_{sin,i}\sin i\omega t + x_{cos,i}\cos i\omega t.$$

For this issue, an inverse Fast Fourier Transformation can be used. An approach with discrete time steps may be used. Alternatively, an analytical approach may be used.

Figure 2:
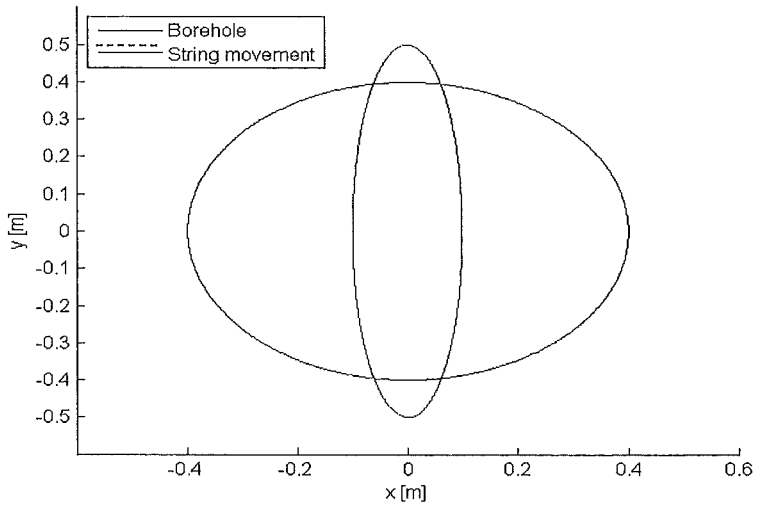
FIG. 2 depicts aspects of movement of the drill string in x and y directions normal to the axis of the drill string.
Figure 3:
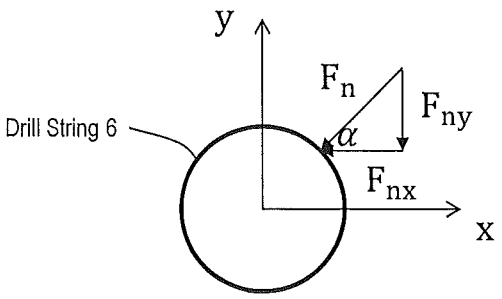
FIG. 3 depicts aspects of x and y force components acting normal to a drill string surface.

In section 8*f*(*ii*), the displacement in the time domain is used to calculate the nonlinear forces in time domain. The nonlinear forces in the time domain are directly dependent on the displacement and on the force law (e.g., the normal force in a borehole can be calculated with a penalty formulation). As mentioned above, the vector x(t) contains translational and rotational degrees of freedom (DOF). The translational DOFs can be denoted x, y and z where x and y describe the lateral displacement between the drill string and the borehole. An example of drill string movement is depicted in FIG. 2. The string movement is described by the dashed curve. The borehole is in this case described by the continuous line. Note that this procedure has to be repeated for every discrete node of the discretized drill string. In case of no intersection with the borehole wall, the normal force is zero. Otherwise the normal force is e.g. proportional to the displacement. The factor relating the displacement to the normal force is called penalty stiffness $k_n$. For every time step t, a radius can be calculated from the two parts of the lateral displacement: $r(t)\sqrt{x(t)^2+y(t)^2}$. The absolute value of the normal force is $F_n(t)=\min(0,k_n(R-r(t))$ where R is the radius of the borehole. The forces in both lateral directions x and y can then be calculated using the following equations with reference to the top view of the drill string 6 in FIG. 3:

$$F_{nx}(t) = \frac{x(t)}{r(t)}F_n(t); \text{ and}$$

$$F_{ny}(t) = \frac{y(t)}{r(t)}F_n(t).$$

Note that $$\sin(\alpha) = \frac{x(t)}{r(t)} \text{ and } \cos(\alpha) = \frac{y(t)}{r(t)}.$$

All other kinds of nonlinear forces are represented in this context like tangential friction forces or forces due to the cutting process for drilling the borehole.

In section 8*f*(*iii*), the Fourier coefficients of the time signal of the nonlinear forces (e.g., the borehole wall contact forces) are calculated. For example a Fast Fourier Transformation (FFT) or Discrete Fourier Transformation (DFT) may be used to calculate the Fourier coefficients in frequency domain for every harmonic k=0 . . . N considered. The normal force $\hat{f}_{nl}$ in frequency domain then can be calculated as follows:

$$f_{nx} = \sum_{i=0}^{N} e^{-2\pi i\frac{jk}{N}} F_{n,x}(t).$$

Figure 4A:
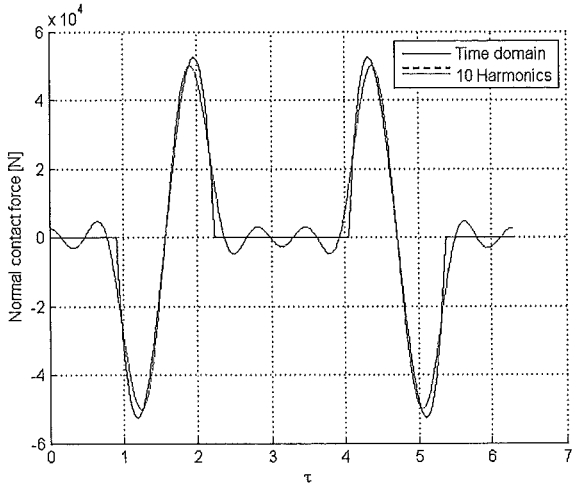
FIGS. 4A and 4B, collectively referred to as FIG. 4, illustrate normal contact forces in the time domain and in the frequency domain for the x and y directions.
Figure 4B:
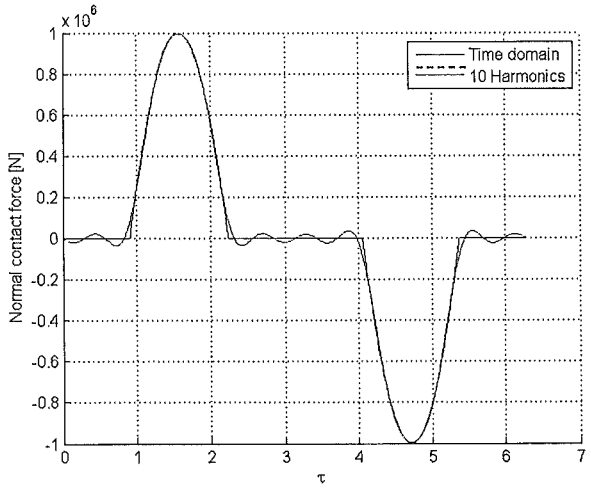

This is an efficient (complex) notation which can be transformed into a real notation with sine and cosine parts of the force. FIG. 4 illustrates an example of normal contact forces in the time domain compared to a Fourier series of the periodic contact forces. FIG. 4A illustrates the contact forces in the x-direction, while FIG. 4B illustrates the contact forces in the y-direction. The continuous line curves show the contact forces calculated in the time domain from the displacement illustrated in FIG. 2. The dashed line curves show the approximation of the Fourier series of this time signal with N=10 harmonics k=0 . . . N.

In section 8*f*(*iv*), a new vector of the displacements is then calculated with the dynamic stiffness matrix S as follows:

$$x_i=S^{-1}(f+f_{nl}(x_{i-1})).$$

Of course this is not solved by calculating the inverse of the dynamic stiffness matrix, but by using an appropriate method like the Gaussian elimination.

In section 8*f*(*v*), the calculation of new vector displacements is repeated until a norm of the residual vector fulfills a previously defined tolerance as follows:

$$|r_i|=|Sx_{i-1}-f_{exc}-f_{nl}(x_{i-1})|<\epsilon.$$

Figure 5:
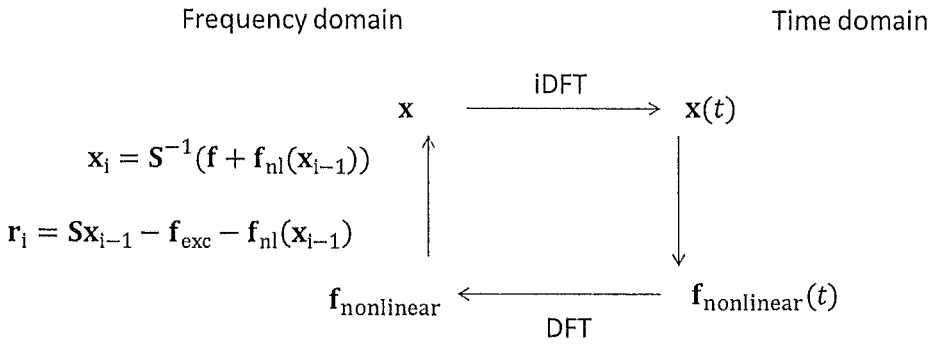
FIG. 5 illustrates one overall process for mathematically modeling the drill string.

This tolerance $\epsilon$ is defined by the Newton like solver. Other criteria to stop the iteration process may be related to the magnitude of the difference between displacement vectors calculated in successive iterations. The overall process is depicted in FIG. 5. The solution of the differential equation of motion (with the dynamic stiffness matrix S) of the system is calculated in the frequency domain under consideration of the amplitude dependent contact forces. The solution vector is developed in a Fourier series with an arbitrary number of harmonics also considering the constant part of the solution which is an (additional) static displacement. Since the contact forces are nonlinear with respect to the amplitude, an iterative solution is necessary. The inverse Discrete Fourier Transform (iDFT) is used to transform the solution vector from the frequency domain into the time domain. Other inverse transforms may also be used.

Figure 6:
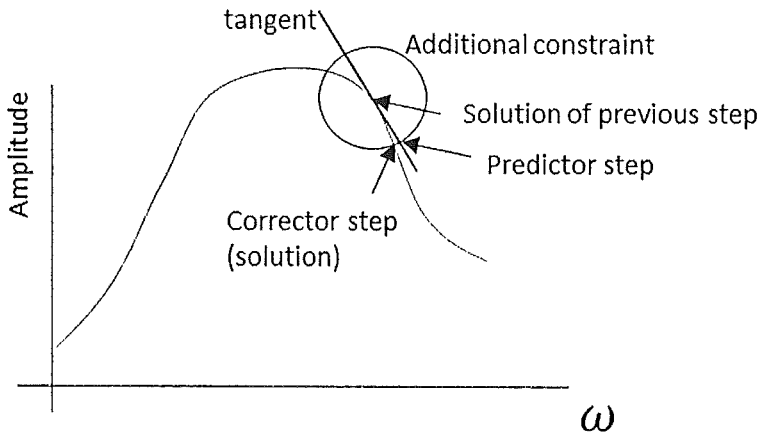
FIG. 6 depicts aspects of incrementing a frequency step size to select a new excitation frequency.

In sub-step 8*g*, a new excitation frequency is selected. A frequency step size control may be implemented to reduce the effort of a frequency sweep. In this context, a continuation method may reduce the effort. Therein, a linear predictor step with the length $s^2$ is performed in the gradient direction of the last excitation frequency to calculate a good approximation of the next excitation frequency and amplitude. The excitation frequency is treated as an additional variable and therefore an additional constraint has to be used. This leads to a better starting point and speed of the iterative solution. This process is depicted in FIG. 6. This method is optional, but will add a new entry into the residual vector because the excitation frequency is not constant during iteration but can have any value on the circle depicted in FIG. 6. Taking $r_2=(x_2-x_1)\cdot(x_2-x_1)+(\omega_2-\omega_1)^2-s^2$ the additional entry in the residual vector is defined which keeps the step length between two solutions equal to the defined value or radius $s^2$.

Technical issues and solutions are discussed next. The degrees of freedom of this method are a multiple of the physical degrees of freedom of the model. The factor is the 1× (additional) static displacement plus 2× the harmonics of the system, corresponding to the sine and cosine part of the solution. Therefore, a linear substitution of the linear degrees of freedom $x_d$ with the degrees of freedom which are actually wall contacts $x_r$ (nonlinear DOFs) may be performed. Therefore the DOFs, the external excitation forces, and the dynamic stiffness matrix S may be divided. This leads to following formulation of the equation of motion:

$$\begin{bmatrix} S_{dd} & S_{dr} \\ S_{rd} & S_{rr} \end{bmatrix} \begin{bmatrix} x_d \\ x_r \end{bmatrix} - \begin{bmatrix} f_d \\ f_r + f_{nl} \end{bmatrix} = \begin{bmatrix} 0 \\ 0 \end{bmatrix}.$$

By calculating the displacement $x_d$ from the first column and substituting this value into the second column, the following equation can be gained. The size of the matrix is equal to the size of $x_r$ and generally much smaller than the dimension of x. The reduced dynamic stiffness matrix may be represented as:

$$Z=S_{rr}-S_{rd}S_{dd}^{-1}S_{dr}.$$

The force vector may be represented as:

$$f_z=f_r-S_{rd}S_{dd}^{-1}f_d.$$

Accordingly, a new residual vector may be represented as:

$$Zx_r-f_z-f_{nl}(x_r)=r=0.$$

The displacement $x_d$ may then be calculated as:

$$X_d=S_{dd}^{-1}(f_d-S_{dr}x_r).$$

Figure 7:
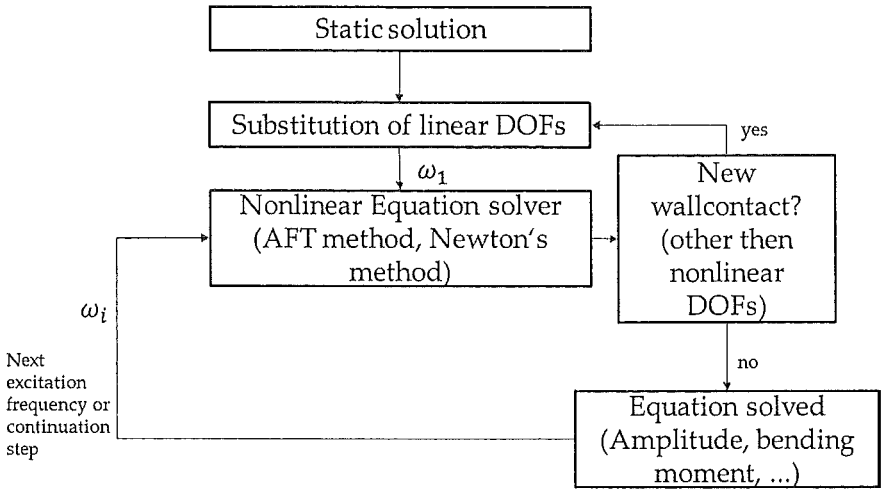
FIG. 7 is a flow chart for a method to provide a solution to equations in the mathematical model.

It is noted that this process is without loss of accuracy and the resulting DOFs are the wall contact DOFs multiplied with the described factor. There may be a small computational cost to substituting the degrees of freedom because if wall contacts change, it is necessary to recalculate the substitution. Nevertheless, if a frequency sweep is performed the wall contacts will only change rarely between two frequency steps. A modal analysis and diagonalization of matrices can be used to efficiently update these matrices between two excitation frequency steps or iterations. This general approach is depicted in a flowchart in FIG. 7.

It can be appreciated that the above disclosed method provides several advantages. One advantage is that the method provides improved accuracy because it accounts for the nonlinear force effects due to the drill string impacting the borehole wall and drill bit interaction with the formation. The method provides a reliable and improved solution regarding the wall contacts to the user and removes the questionable and nontransparent decision if a wall contact is fixed or not. All nonlinear external forces like bit forces, contact forces (rotor-stator, drill string-borehole, contact areas in probes) can be accounted for in the solution. By knowing the steady state response of the drill string system, a reliable optimization and design of tools or bottomhole assemblies (BHAs) regarding the global vibratory behavior of the system is possible (e.g. prediction of resonance frequencies). Note that the resonance frequencies and the displacements are not necessarily equal to the eigenfrequencies and mode shapes of the linear system due to the (e.g. stiffening effect) of the nonlinear contact forces. Further, because of the computational efficiency of the disclosed method, the steady state response of the drill string system may be calculated in real time.

When the steady state response of the drill string system is calculated in real time, the steady state response may be input to a controller (such as the computer processing system 12 in order control drilling parameters generally implemented by the drill rig 6. Non-limiting examples of controllable drilling parameters include weight-on-bit, drill string rotational speed, torque applied to drill string, rate of penetration, drilling fluid density, drilling fluid flow rate, and drilling direction. Hence, in one or more embodiments, the processor implementing the disclosed method may output the calculated steady state response of the drill string as a signal to a controller having a control algorithm. The controller is configured to provide a control signal to a controllable drilling device such as a device that may control at least one of the above listed drilling parameters. The algorithm is configured to determine when a drill string response exceeds a selected threshold, such as the number of borehole wall contacts and the force imposed on the drill string due to each impact, and to control the drilling device such that the selected threshold is not exceeded. In one or more embodiments, the control algorithm may be at least one of (a) a feedback control loop with the calculated steady state drill string response as the input and (b) a neural network configured to learn drill string system responses due to variations in the drilling parameters input into the neutral network. In one or more embodiments, the drilling parameter sensor 13 provides a drilling parameter input in real time to the processing system or controller in order for the processing system or controller to calculate in real time the excitation forces being applied to the drill string by the drill rig.

It can be appreciated that, in one or more embodiments, a relationship between the non-linear excitation force applied to the drill string (such as by borehole wall contact or drill bit cutting the into the formation) and the drill string displacement may be determined by laboratory testing using the same or similar drill string components and the same or similar formation materials or lithology.

In support of the teachings herein, various analysis components may be used, including a digital and/or an analog system. For example, the downhole electronics 11, the computer processing system 12, or the sensors 7, 8 or 13 may include digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements. The term "coupled" relates to a first component being coupled to a second component either directly or through an intermediate component.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for estimating a steady state response of a drill string disposed in a borehole penetrating at least one of the earth and another material, the method comprising:

calculating a first displacement of the drill string in a frequency domain for a first excitation force frequency and a number of multiples of this frequency using an equation of motion of the drill string that is solved by a processor, the equation of motion having a static force component, an excitation force component, and a non-linear force component with respect to at least one of a deflection and a derivative of the deflection of the drill string;

transforming the first displacement from the frequency domain into a time domain using the processor;

calculating a non-linear force in the time domain based on at least one of the calculated displacement and a derivative of the calculated displacement using the processor;

calculating a frequency domain coefficient derived from the calculated non-linear force in the time domain using the processor; and calculating a second displacement of the drill string in the frequency domain using the equation of motion and the frequency domain coefficient using the processor.

2. The method according to claim 1, further comprising:

calculating a residual value r corresponding to a closeness of a solution to the equation of motion; and determining if the residual value r is less than a tolerance $\epsilon$.

3. The method according to claim 2, further comprising using the second displacement as the steady state response if the residual value r is less than the tolerance $\epsilon$.

4. The method according to claim 2, further comprising repeating the steps of claim 1 using a second excitation force frequency if the residual value r is not less than the tolerance $\epsilon$.

5. The method according to claim 4, wherein the second excitation force frequency and a displacement is determined using at least one of a linear approximation in a gradient direction prediction determined from the second displacement and an approximation with a Taylor series determined from the second displacement.

6. The method according to claim 5, wherein a change in the second excitation force and the displacement is constrained.

7. The method according to claim 1, further comprising receiving with the processor a mathematical model of the drill string disposed in the borehole and using the mathematical model to calculate the non-linear force, the mathematical model comprising borehole information describing the borehole and drill string information describing the drill string.

8. The method according to claim 7, wherein the borehole information comprises at least one of a borehole caliper log obtained by a downhole caliper tool, borehole survey information, and a geometry of a planned borehole.

9. The method according to claim 7, wherein the drill string information comprises a geometry of the drill string expressed in at least one of a finite element model, a finite differences model, a discrete lumped mass model, and an analytical model of the drill string.

10. The method according to claim 7, wherein the drill string information comprises a mass of the drill string.

11. The method according to claim 1, further comprising calculating a static solution to the equation of motion with dynamic force set to zero.

12. The method according to claim 11, wherein the static solution is used to provide equation of motion coefficients.

13. The method according to claim 12, wherein the equation of motion comprises:

$$M\ddot{x}+C\dot{x}+Kx=f+f_{nl}$$

where f is a force vector representing a dynamic force applied to the drill string, $f_{nl}$ is a non-linear force vector representing non-linear forces applied to the drill string, x is a displacement vector, M is a mass matrix, C is a damping matrix, and K is a stiffness matrix.

14. The method according to claim 12, further comprising calculating a dynamic stiffness S relating a dynamic force to a displacement using one or more of the equation of motion coefficients.

15. The method according to claim 1, further comprising calculating a starting vector $x_{Start}$ as the linear solution of the equation of motion without nonlinear forces.

16. A method for drilling a borehole penetrating an earth formation, the method comprising:

drilling a borehole with a drill rig that operates a drill string having a drill bit;

obtaining borehole geometry data;

calculating a first displacement of the drill string in a frequency domain for a first excitation force frequency using an equation of motion of the drill string that is solved by a processor, the equation of motion having a static force component, an excitation force component, and a non-linear force component with respect to at least one of a deflection and a derivative of the deflection of the drill string;

transforming the first displacement from the frequency domain into a time domain using the processor;

calculating a non-linear force in the time domain based on the borehole geometry data and at least one of the calculated displacement and a derivative of the calculated displacement using the processor;

calculating a frequency domain coefficient derived from the calculated non-linear force in the time domain using the processor; and calculating a second displacement of the drill string in the frequency domain using the equation of motion and the frequency domain coefficient using the processor; and transmitting a control signal from the processor to the drill rig to control a drilling parameter, the processor being configured to execute a control algorithm having the second displacement as an input.

17. The method according to claim 16, wherein obtaining borehole geometry data comprises:

conveying a downhole caliper tool disposed at the drill string through the borehole being drilled;

performing borehole caliper measurements with the downhole caliper tool to provide borehole geometry data; and transmitting the borehole geometry data from the caliper tool to a processor.

18. The method according to claim 16, wherein the drilling parameter comprises weight-on-bit, rate of penetration, rotational speed of the drill string, torque applied to drill string, drilling fluid flow rate, drilling direction, or some combination thereof.

19. The method according to claim 16, wherein the control algorithm comprises a neural network.

20. The method according to claim 16, wherein the control algorithm is configured to control drill string vibration to below a selected threshold value.

21. The method according to claim 20, wherein the control algorithm is configured to control a force of impact of the drill string against a wall of the borehole.

22. The method according to claim 16, further comprising receiving with the processor a sensed drilling parameter from a drilling parameter sensor, the sensed drilling parameter being input into the control algorithm.

23. The apparatus according to claim 20, further comprising a drilling parameter sensor coupled to the controller and configured to sense a drill parameter that is input into the control algorithm.

24. An apparatus for drilling a borehole penetrating an earth formation using a drill rig configured to operate a drill string having a drill bit, the apparatus comprising:

a borehole caliper tool disposed at the drill string and configured to provide borehole geometry data;

a processor configured to receive the borehole geometry data and to implement a method comprising:

calculating a first displacement of the drill string in a frequency domain for a first excitation force frequency using an equation of motion of the drill string, the equation of motion having a static force component, an excitation force component, and a non-linear force component with respect to at least one of a deflection and a derivative of the deflection of the drill string;

transforming the first displacement from the frequency domain into a time domain;

calculating a non-linear force in the time domain based on the borehole geometry data and at least one of the calculated displacement and a derivative of the calculated displacement;

calculating a frequency domain coefficient derived from the calculated non-linear force in the time domain; and calculating a second displacement of the drill string in the frequency domain using the equation of motion and the frequency domain coefficient;

a controller configured to receive the second displacement and to transmit a control signal to the drill rig to control a drilling parameter, the controller being configured to execute a control algorithm having the second displacement as an input.

* * * * *